US009676452B2

(12) United States Patent
Nowack

(10) Patent No.: US 9,676,452 B2
(45) Date of Patent: Jun. 13, 2017

(54) DAMPENING PLATFORM

(71) Applicant: Paul F. Nowack, Stuart, FL (US)

(72) Inventor: Paul F. Nowack, Stuart, FL (US)

(73) Assignee: Paul F. Nowack, Stuart, FL (US)

( * ) Notice: Subject to any disclaimer, the term of this patent is extended or adjusted under 35 U.S.C. 154(b) by 0 days.

(21) Appl. No.: 15/095,965

(22) Filed: Apr. 11, 2016

(65) Prior Publication Data

US 2017/0057599 A1 Mar. 2, 2017

Related U.S. Application Data

(60) Provisional application No. 62/209,617, filed on Aug. 25, 2015.

(51) Int. Cl.
*B63B 17/00* (2006.01)

(52) U.S. Cl.
CPC ..... *B63B 17/0081* (2013.01)

(58) Field of Classification Search
CPC ..... B63B 17/0081
USPC ..... 248/624; 114/363
See application file for complete search history.

(56) References Cited

U.S. PATENT DOCUMENTS 5,516,126 A * 5/1996 Myers ..... A63C 5/00 280/14.28
2011/0045955 A1* 2/2011 Savane ..... A63B 22/0056 482/52

* cited by examiner

*Primary Examiner* — Anthony Wiest
(74) *Attorney, Agent, or Firm* — Duane Morris LLP; J. Rodman Steele, Jr.; Gregory M. Leftkowitz

(57) ABSTRACT

A dampening platform includes a base and a first pedal assembly coupled to a first side of the base. The first pedal assembly includes a first pedal pivotably rotatable about a first pivot point at a first end of the first pedal. A first dampener is operatively coupled to the first pedal. The first dampener is configured such that the dampener is at less than full compression under a load of about 200 lbs. The first pedal assembly is slideably coupled to the base. A position of the first pedal assembly is laterally adjustable with respect to the base.

13 Claims, 22 Drawing Sheets

DAMPENING PLATFORM

CROSS-REFERENCE TO RELATED APPLICATIONS

This application claims benefit under 37 C.F.R. §119(e) to U.S. Provisional Appl. No. 62/209,617, filed on Aug. 25, 2015, and entitled "Dampening Platform," which is hereby incorporated by reference in its entirety.

BACKGROUND

Operators of water craft, such as boats, ships, jet skis, etc., are subjected to one or more forces during operation of the water craft. For example, during acceleration, operators may be subject to a downward force generated by the water craft. Operators are also subject to forces generated by interactions between the water craft and the surface of the water, for example, forces generated by waves. These forces can cause an operator discomfort and/or injury and may result in the operator being dislodged from an operating position on the water craft.

SUMMARY

In various embodiments, a dampening platform is disclosed. The dampening platform includes a base and a first pedal assembly coupled to a first side of the base. The first pedal assembly includes a first pedal pivotably rotatable about a first pivot point at a first end of the first pedal. A first dampener is operatively coupled to the first pedal. The first dampener is configured such that the dampener is at less than full compression under a load of about 200 lbs.

In various embodiments, a dampening platform is disclosed. The dampening platform includes a base. A first pedal assembly and a second pedal assembly are coupled to a first side of the base. The first pedal assembly includes a first pedal pivotably rotatable about a first pivot point at a first end of the first pedal. A first dampener is operatively coupled to the first pedal. The second pedal assembly includes a second pedal pivotably rotatable about a second pivot point at a first end of the second pedal. A second dampener is operatively coupled to the second pedal. Each of the first dampener and the second dampener is configured such that the dampener is at less than full compression under a load of about 200 lbs.

BRIEF DESCRIPTION OF THE DRAWINGS

The features and advantages of the present invention will be more fully disclosed in, or rendered obvious by the following detailed description of the embodiments, which are to be considered together with the accompanying drawings wherein like numbers refer to like parts and further wherein.

DETAILED DESCRIPTION

Figure 1:
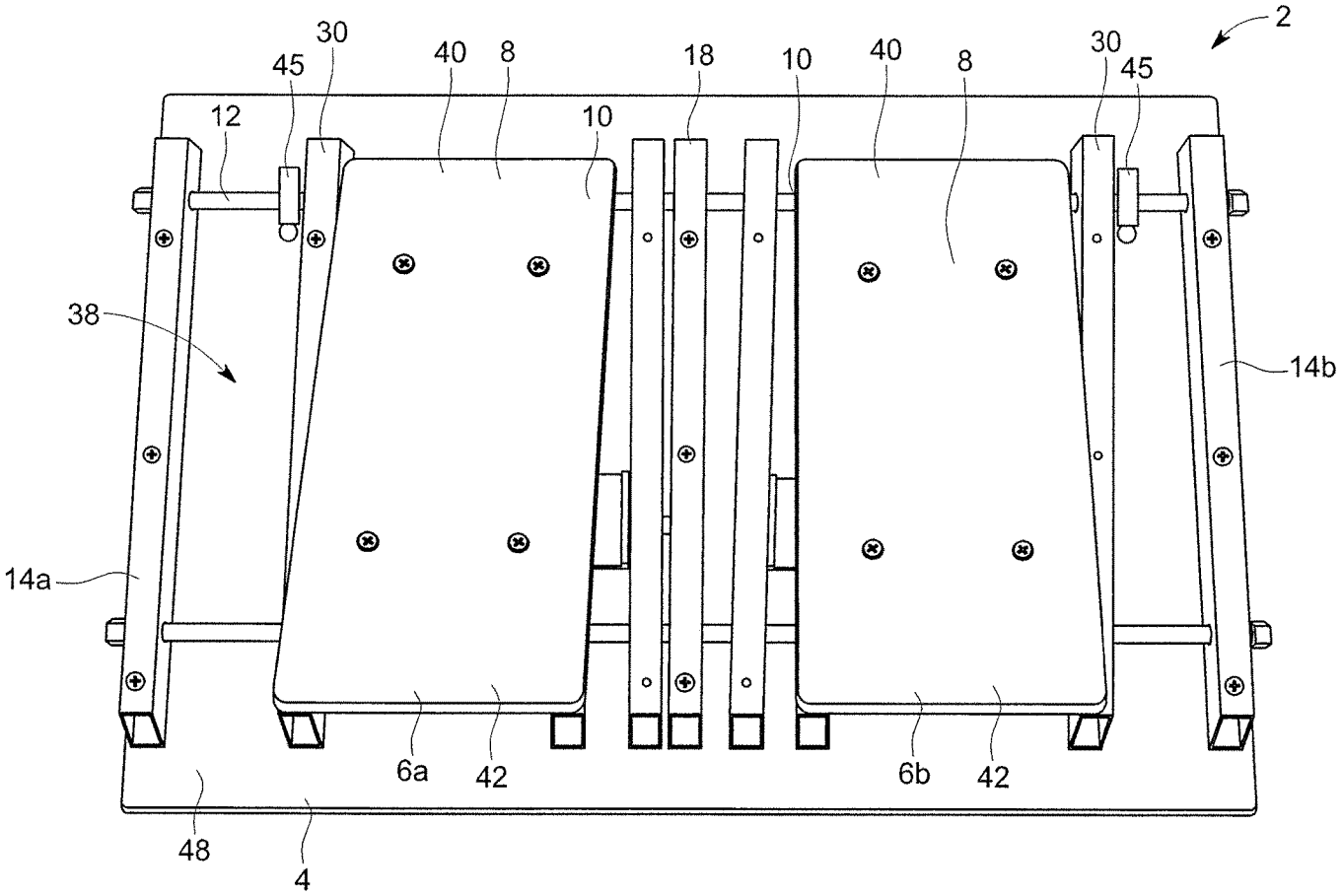
FIG. 1 illustrates one embodiment of a dampening platform.
Figure 2:
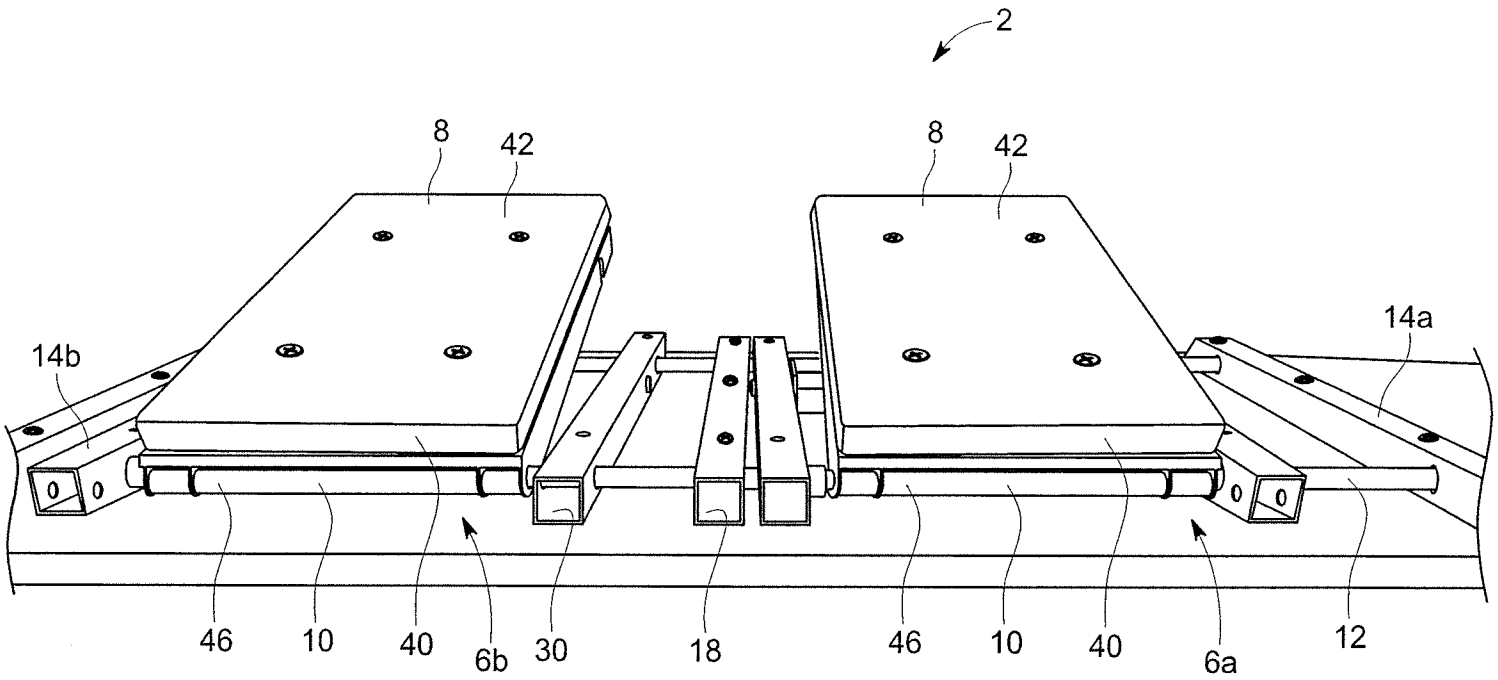
FIG. 2 illustrates a front-view of the dampening platform of FIG. 1.

The description of the preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In this description, relative terms such as "horizontal," "vertical," "up," "down," "top," "bottom," as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both moveable or rigid attachments or relationships, unless expressly described otherwise, and includes terms such as "directly" coupled, secured, etc. The term "operatively coupled" is such an attachment, coupling, or connection that allows the pertinent structures to operate as intended by virtue of that relationship.

In various embodiments, a dampening platform is disclosed. The dampening platform includes at least one pedal assembly. The at least one pedal assembly includes a pedal and a dampener operatively coupled to the pedal. The pedal is rotatable about a pivot point at a first end. The dampener is configured to absorb a predetermined force such a second end of the pedal maintains at least a predetermined spacing from the base when under the predetermined load. For example, in some embodiments, the dampening platform is configured to absorb a force generated on a user during operation of a water vessel, such as a boat, while maintaining at least a predetermined spacing between the second end of the pedal and the base, wherein the predetermined spacing allows for shock absorption for a user standing on the pedal(s) when the vessel experiences a shock inducing event (e.g., hits a wave or wake).

FIGS. 1-9 illustrate embodiments of a dampening platform 1. The dampening platform 2 includes a base 4. A first pedal assembly 6*a* is coupled to a first side 38 of the base 4. In some embodiments, a second pedal assembly 6*b* is coupled to the first side 38 of the base 4. Each of the pedal assemblies 6 include a pedal 8 rotatable about a pivot point 10. The pivot point 10 is located at a first end 40 of the pedal 8. In the illustrated embodiment, the first end 40 of the pedal 8 comprises a front end configured to receive a front portion of a user's foot. The pedal assemblies 6 are located between a first side support 14*a* and the second side support 14*b* (collectively "side supports 14") coupled to the base 4.

Figure 3:
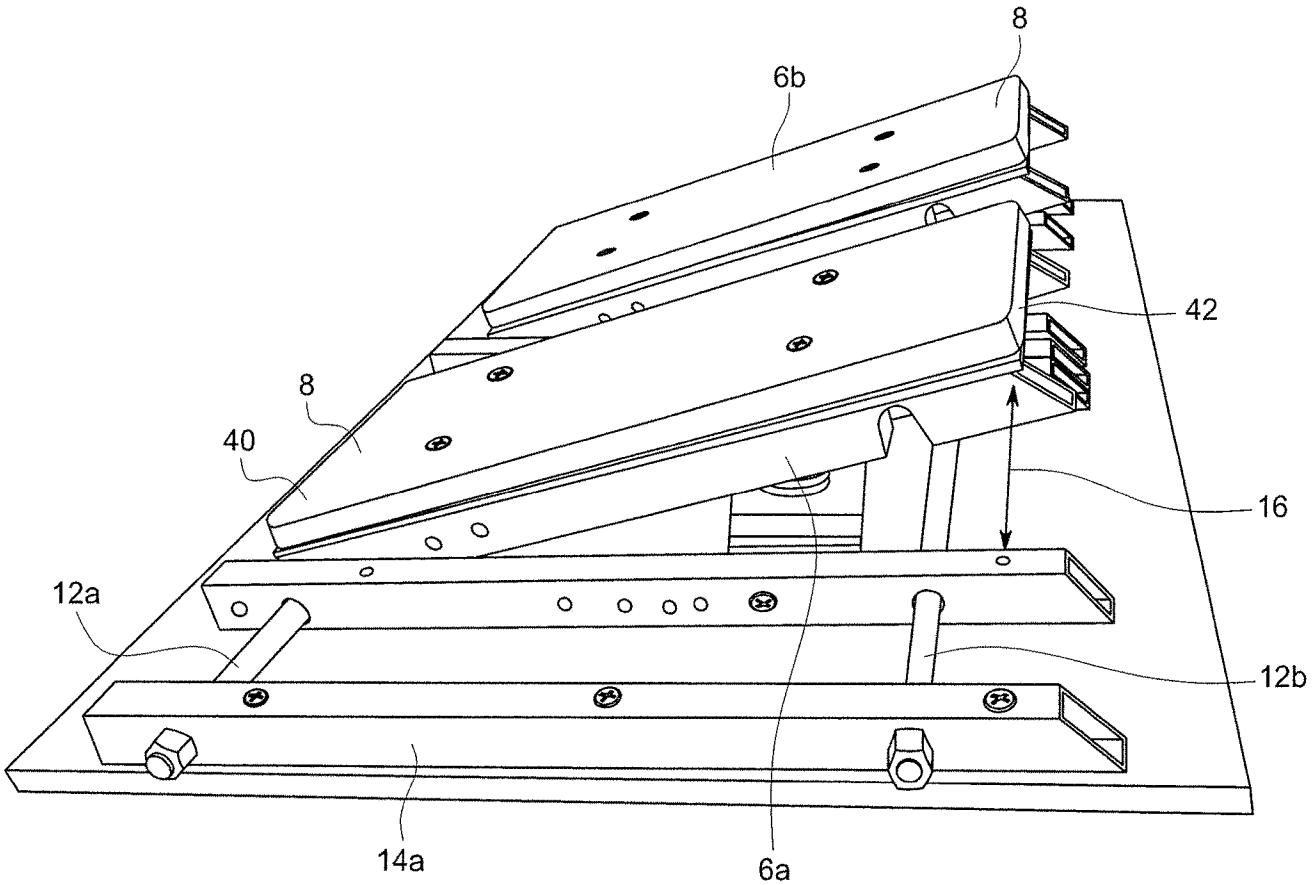
FIG. 3 illustrates a side-view of the dampening platform of FIG. 1.
Figure 4:
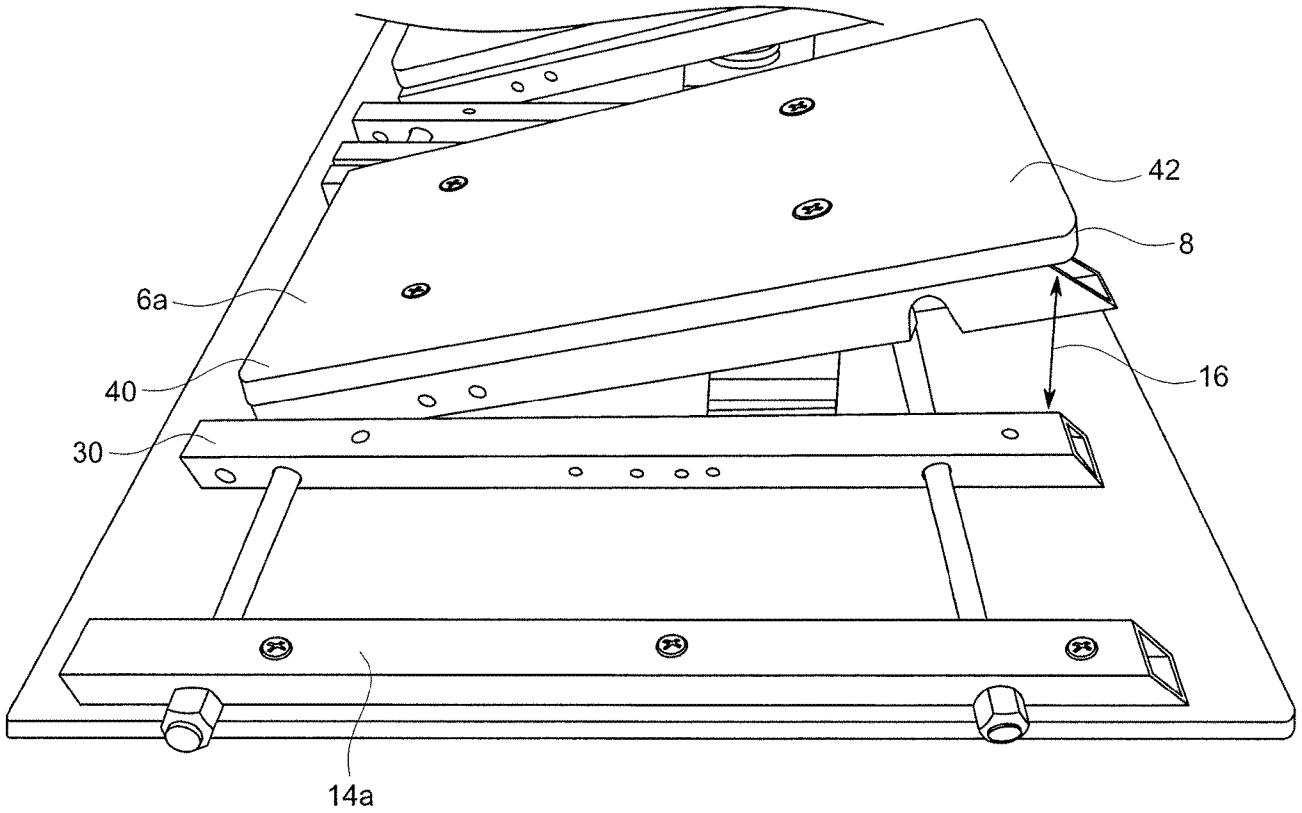
FIG. 4 illustrates one embodiment of a pedal assembly of the dampening platform of FIG. 1.

In some embodiments, each of the pedal assemblies 6 include a dampener 20 positioned between the pedal 8 and the base 4. The dampener 20 is configured to absorb a force exerted by a user on a pedal 8. For example, in some embodiments, the dampener 20 is configured to absorb a force generated on a user during operation of a boat, such as during high-speed operation of the boat. As shown in FIG. 3, the dampener 20 maintains a second end 42 of the pedal 8 spaced apart from the base 4. In some embodiments, the dampener 20 is configured maintain the second end 42 of the pedal 8 at a position above the base 4, e.g., the dampener 20 is configured such that the spacing 14 between the second end 42 of the pedal 8 and the base 4 is greater than zero under load to prevent the pedal 8 from bottoming out. For example, in some embodiments, the dampener 20 is configured to absorb a force normal to the dampener 20 of about 200 lb. while maintaining a spacing between the second end 42 and the base 4. Although loads of about 200 lbs. are discussed herein, it will be appreciated that the dampener 20 can be configured to support any predetermined load, such as, for example, 150 lbs., 175 lbs., 200 lbs., 225 lbs., 250 lbs, 275 lbs., 300 lbs., etc.

In some embodiments, the dampener 20 is configured to maintain at least a minimum spacing 16 between the base 4 and the second end 42 of the pedal 8 under a specific load. For example, in some embodiments, the dampener 20 is configured to maintain a spacing of about 1" under a predetermined load. The minimum spacing, or play, in the dampener 20 can be configured such that if a force greater than the predetermined force is applied (e.g., when a boat encounters a wave), the dampener 20 maintains a non-zero spacing 16 between the pedal 8 and the base 4, e.g., prevents the pedal 8 from bottoming out.

In some embodiments, the dampener 20 includes at least one spring 22. The at least one spring 22 is positioned between the pedal 8 and the base 4 rearward of the pivot point 10. The at least one spring 22 has a spring constant that is configured to prevent the spring 22 from fully compressing when under a predetermined load. In some embodiments, the spring 22 is configured to absorb a force generated by a 200 lb. load without fully compressing, for example, maintaining a length of at least 1" greater than a full compression when a predetermined load is applied normal to the spring 22. The spring 22 may be configured to maintain a length less than a full compression under any suitable predetermined load, such as, for example, 150 lbs., 175 lbs., 200 lbs., 225 lbs., 250 lbs., 275 lbs., 300 lbs., etc. In some embodiments, the dampener 20 includes two or more springs 21. The spring 22 can be any suitable spring or combination of springs, such as, for example, coil springs, leaf springs, torsions springs, and/or any combination thereof.

In some embodiments, a position of each of the first and second pedal assemblies 6 is laterally adjustable (e.g., side-to-side in FIG. 1). In some embodiments, one or more slide bars 12 are coupled to the base 4. For example, in some embodiments, the slide bar 12 is coupled between a first side support 14*a* and a second side support 14*b*. The pedal assemblies 6 can be slideable on the slide bar(s) 12. For example, FIG. 3 shows a pedal assembly 6 slideably coupled to front and rear slide bars 12*a*, 12*b*. The pedal assemblies 6 may be freely slideable between a side support 14 and a middle support 18 of the dampening platform 2. Each of the pedal assemblies 6 may move laterally in response to a force applied to the pedal 8. For example, in some embodiments, if a greater force is applied to the pedals 8, the pedal assemblies 6 slide away from the middle support bar 18 to provide a wider stance profile. In some embodiments, a locking element 45 is configured to lock one or more of the pedal assemblies 6 in a fixed position. In some embodiments, a slide bar 12 defines the pivot point 10 of each of the pedals 8. For example, in some embodiments, the pedal 8 includes a channel 46 sized and configured to receive a slide bar 12 or another bar therethrough. In some embodiments, the pivot point 10 can be defined by a hinge or any other suitable structure.

In some embodiments, the dampener 20 is coupled to a dampener support 24. The dampener support 24 can comprise a platform or bar configured to support the dampener 20 thereon. The dampener support 24 can be coupled to one or more supports 30 of the pedal assembly 6 to position of the dampener 20 with respect to the pedal 8. In some embodiments, the dampener 20 is coupled to a dampener support 24 that is fixedly coupled to pedal assembly supports 30. In some embodiments, the supports 30 are slideably coupled to the slide bar 12. The fixed dampener support 24 maintains the position of the dampener 20 with respect to a the pedal 8 and the pivot point 10 when the pedal assembly 6 is moved laterally with respect to the base 4.

Figure 7:
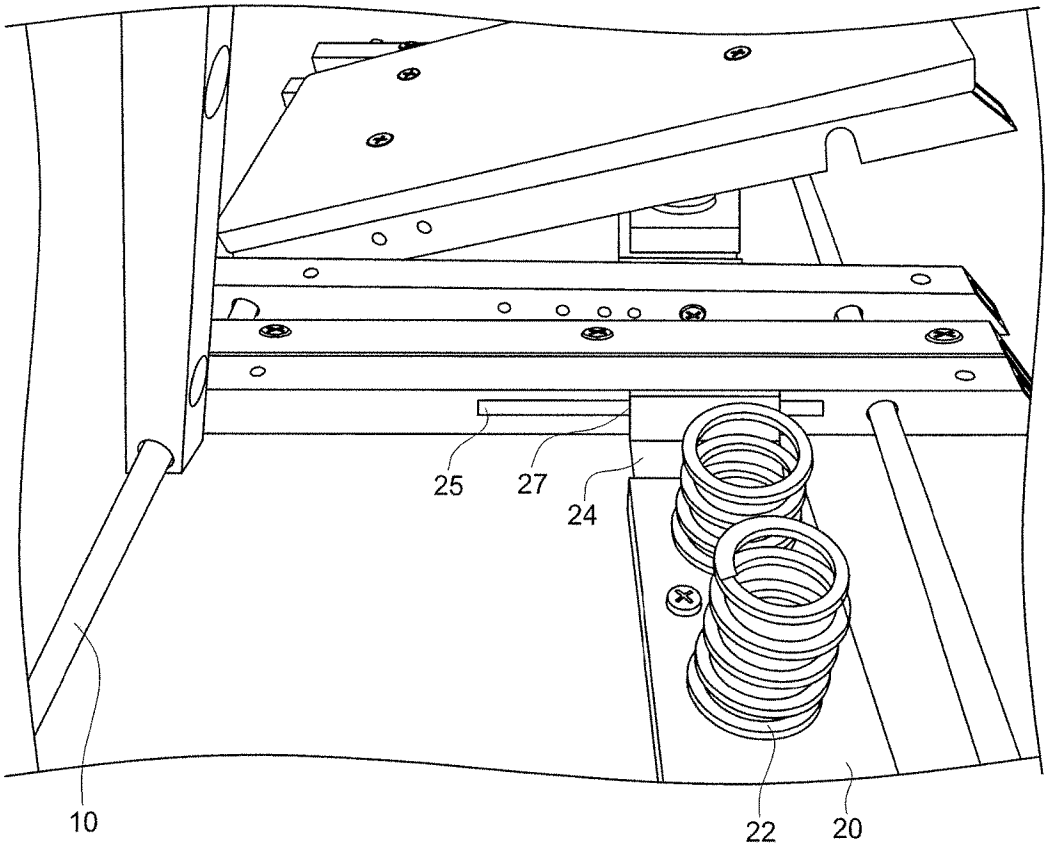
FIG. 7 illustrates a side-view of the dampener of FIG. 5.
Figure 8:
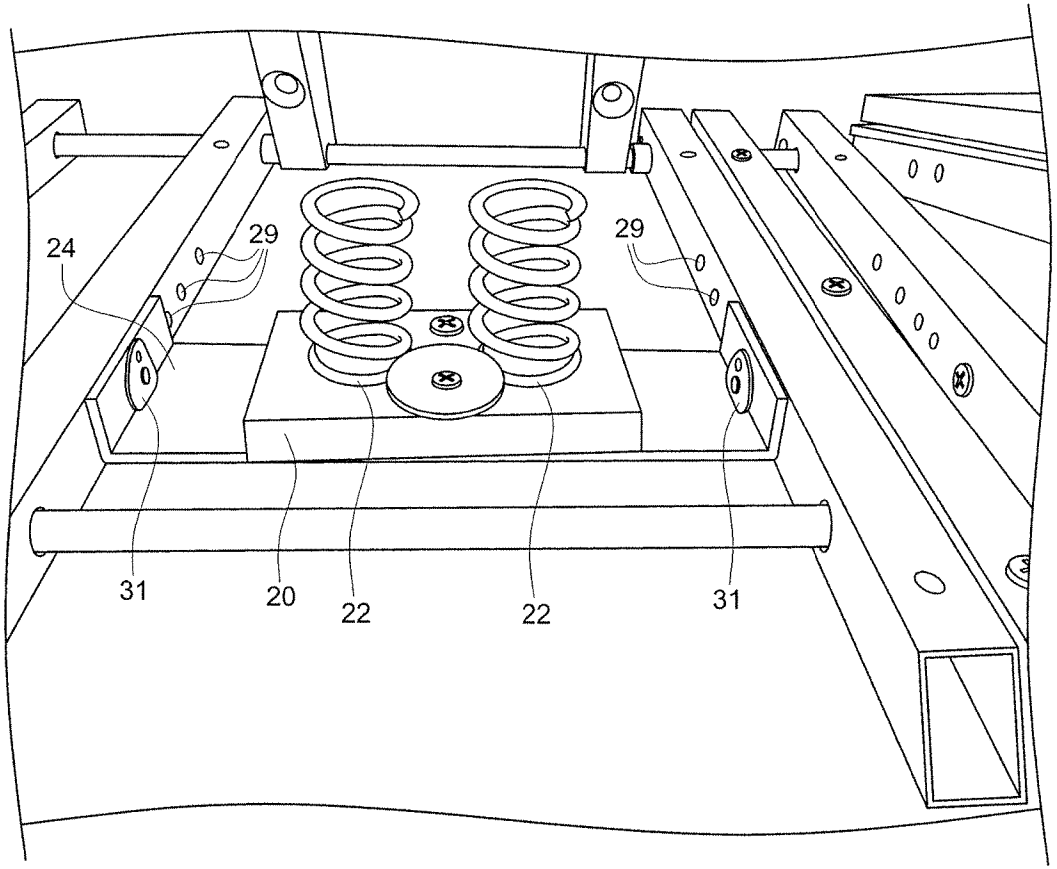
FIG. 8 illustrates one embodiment of a dampener coupled to a pedal assembly of the dampening platform.

In some embodiments, the dampener support 24 is longitudinally moveable with respect to the pivot point 10 of the pedal 8. The dampener support 24 can be moved closer to or further from the pivot point 10 to alter the predetermined force supportable by the pedal 8 at less than full compression of the dampener 20. For example, as shown in FIG. 7, in some embodiments, one or more supports 30 include a tongue 25 and the dampener support 24 includes a groove 27. The tongue 25 and the groove 27 are operatively coupled to allow the dampener support 24 to slide longitudinally. Although the illustrated embodiment shows the tongue 25 formed on the support and the groove 27 formed in the dampener support 24, it will be appreciated that the positions of the tongue 25 and the groove 27 can be reversed. As another example, as shown in FIG. 8, the support 30 can include a plurality of mounting holes 29. The plurality of mounting holes 29 define a plurality of predetermined positions for the dampener support 24. The dampener support 24 includes a mounting element 31 (e.g., screws or bolts) sized and configured to releasably attach the dampener support 24 to one or more of the plurality of mounting holes 29 (e.g., threaded to receive the mounting element). The position of the dampener 20 is adjustable by moving the releasably attached mounting elements 31 to corresponding holes 29. It will be appreciated that a greater of lesser number of predetermined positions can be defined by a lesser or greater number of mounting holes 29.

Figure 5:
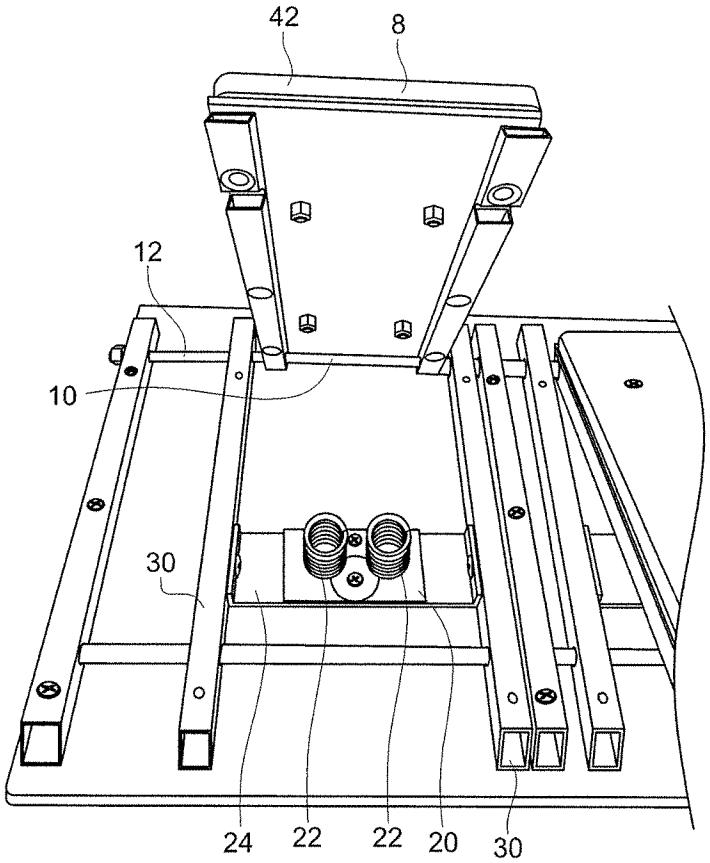
FIG. 5 illustrates one embodiment of a dampening assembly of FIG. 4 with the left pedal assembly lifted up from the left dampener.
Figure 6:
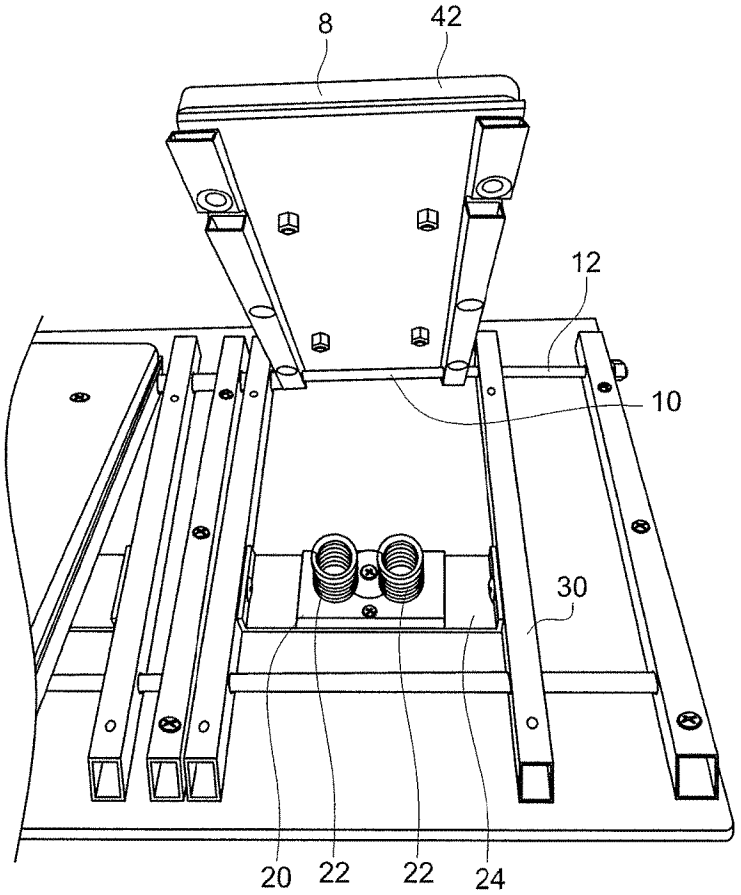
FIG. 6 illustrates a rear view of the dampener of FIG. 5, with the left pedal assembly supported by the left dampener and the right pedal assembly lifted up to show the right dampener.

As shown in FIGS. 5 and 6, in some embodiments, each of the pedals 8*a*, 8*b* is independently rotatable around the pivot point 10. Each of the pedal assemblies 6 is configured to support at least the predetermined force. For example, in some embodiments, each of the pedal assemblies 6 include a dampener 20 configured to maintain the pedal in a raised position under at least a 200 lb. load. Each of the pedal assemblies 6 can individually support a predetermined load without reaching full compression, allowing a user to transfer the entire force to one of the pedal assemblies 6 without bottoming out the pedal 8. In other embodiments, each of the pedal assemblies 6 is configured to support a portion of the predetermined force.

In some embodiments, the first end 40 of the pedals 8 is adapted for receiving the front of a shoe. For example, in some embodiments, the first end 40 of the pedal 8 includes a cutout for receiving the front of a shoe therein. In some embodiments, the first end 40 includes a raised portion abutting the front of a shoe. In some embodiments, the first end 40 includes a non-slip coating configured to maintain the position of a front of a shoe.

Figure 9:
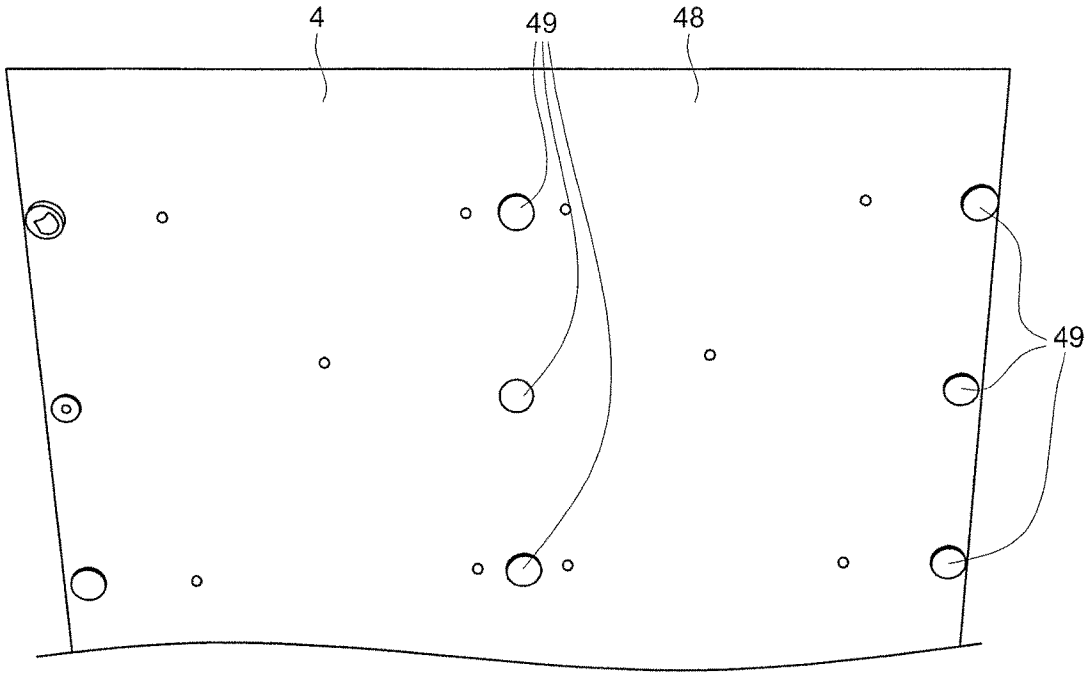
FIG. 9 illustrates one embodiment of a bottom side of the base of the dampening platform of FIG. 1.

FIG. 9 illustrates one embodiment of a bottom surface 48 of the base 4. In some embodiments, the base 4 defines a uniform, rigid, continuous base (e.g., not foldable). The base 4 has a predetermined length and width sufficient to fully support the one or more pedal assemblies 6. In some embodiments, the bottom surface 48 of the base 4 includes non-slip portions 49. For example, in some embodiments, the bottom surface 48 includes a coating configured to prevent the base 4 from sliding on a wet surface, such as a boat deck. In other embodiments, the base 4 can comprise a non-uniform and/or non-continuous base and can include one or more non-rigid members.

Figure 10:
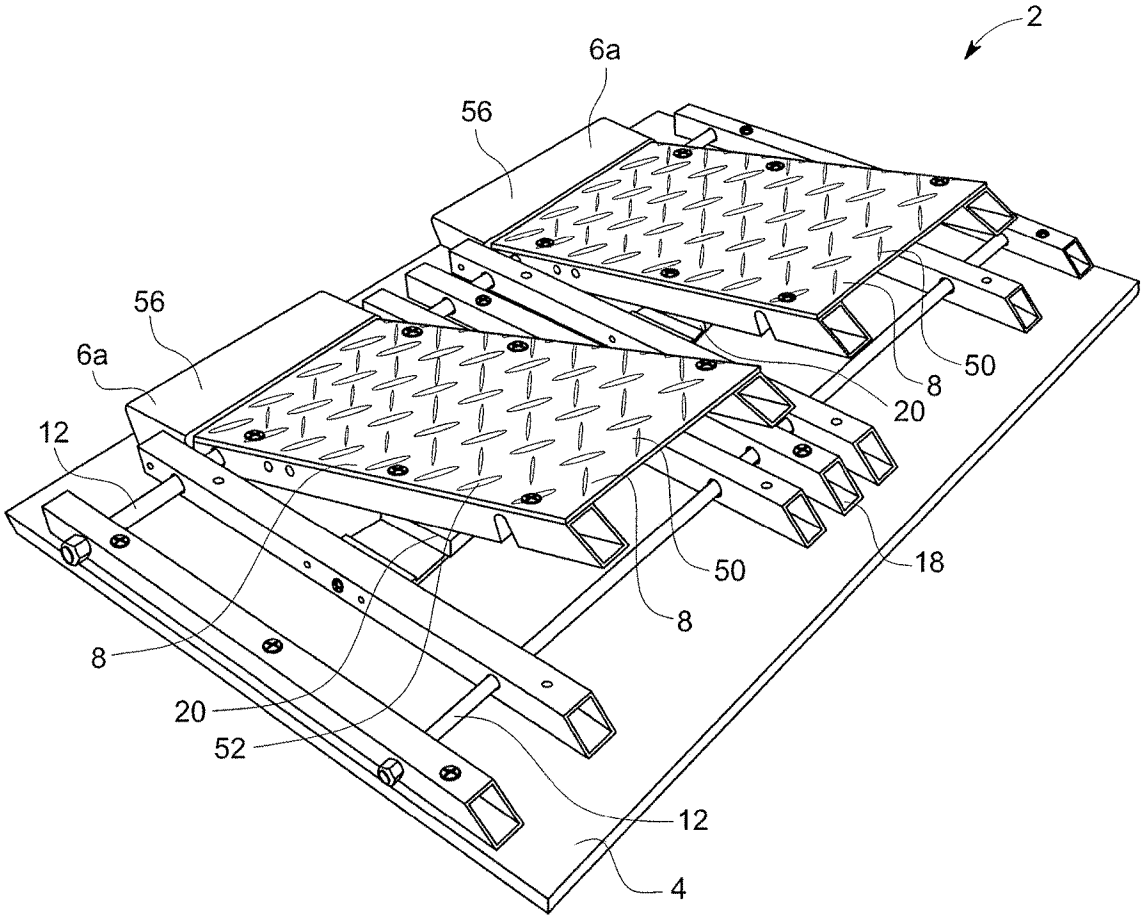
FIG. 10 illustrates one embodiment of a dampening platform including one or more pedals having a non-slip surface.
Figure 11:
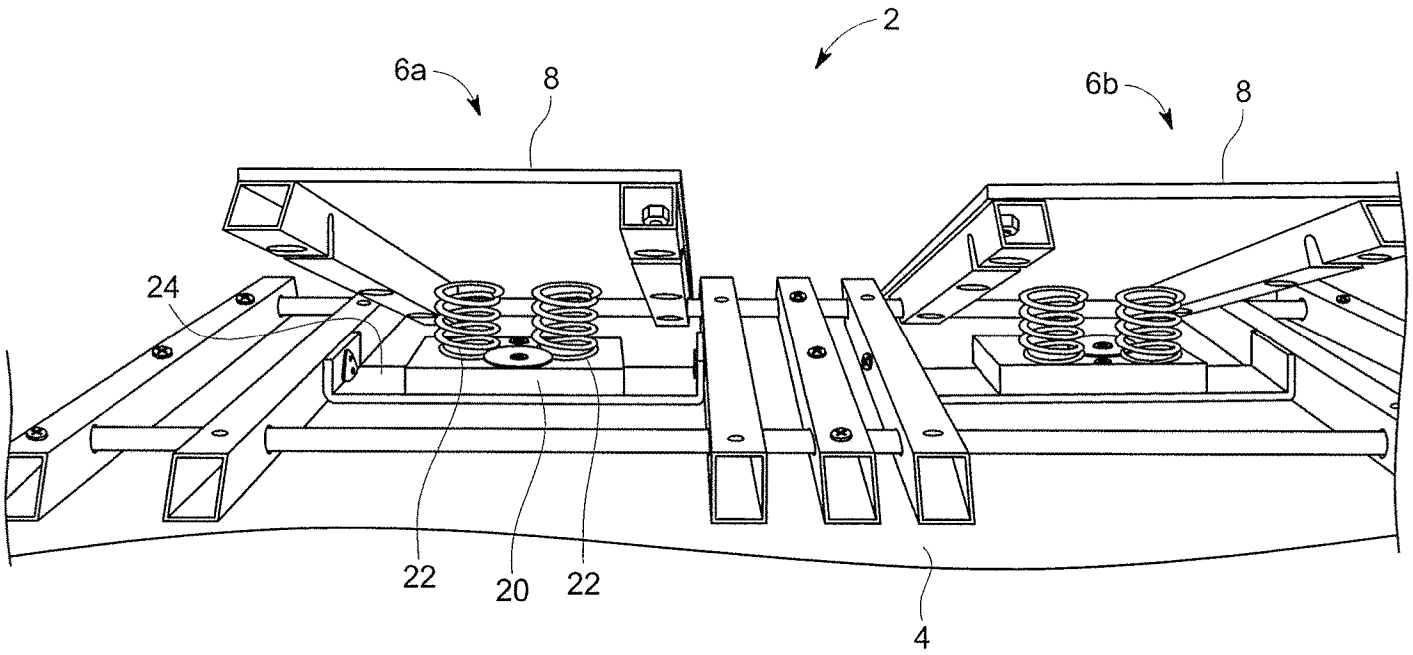
FIG. 11 illustrates a rear-view of the dampening platform of FIG. 10.
Figure 12:
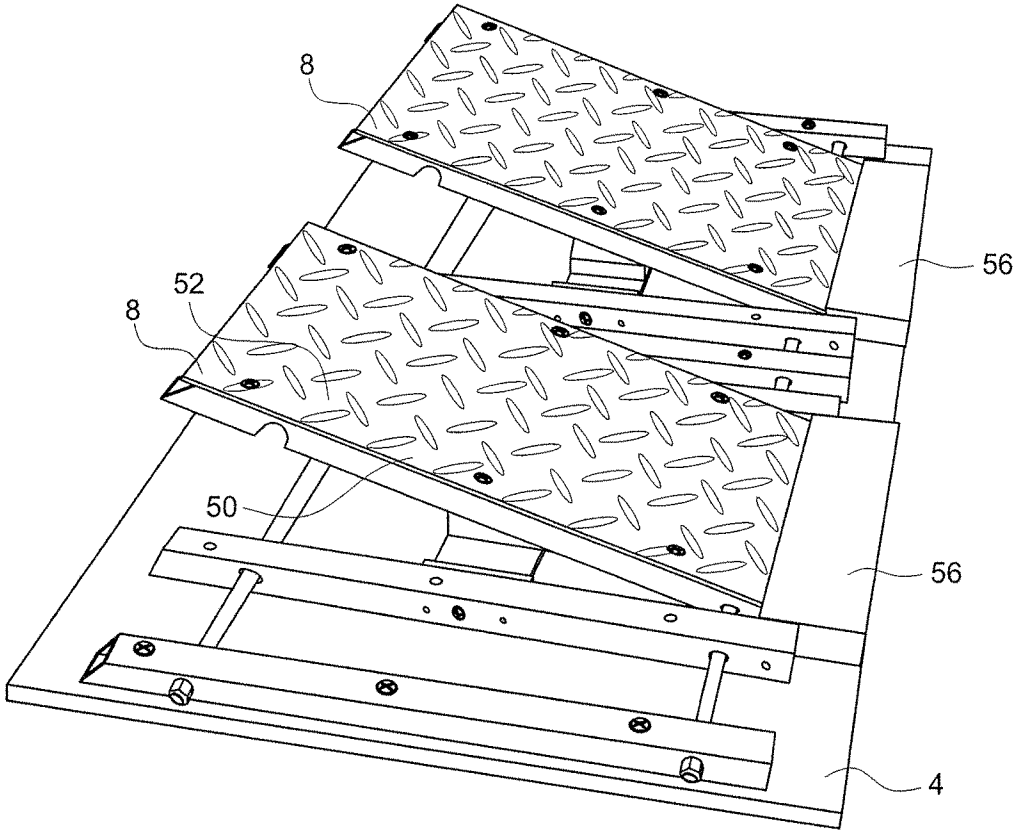
FIG. 12 illustrates a side-view of the dampening platform of FIG. 10.

FIGS. 10-12 illustrate an alternative embodiment of a dampening platform 2 including at least one pedal 8 having a non-slip surface 50 thereon. The dampening platform 2 is similar to the dampening platform 2 described in conjunction with FIGS. 1-9, and similar description is not repeated herein. The dampening platform 2 includes a first pedal assembly 6*a* and a second pedal assembly 6*b* (collectively "pedal assemblies 6"). Each of the pedal assemblies 6 includes a pedal 8 and a dampener 20. At least one of the pedals 8 includes a non-slip surface 50. The non-slip surface 50 can comprise any suitable surface configured to prevent a user's foot from slipping during use. For example, in the illustrated embodiment, the non-slip surface 50 comprises a surface having a plurality of raised projections 52 configured to generate sufficient friction to prevent movement of a user's foot when in contact with the pedal 8. The front end 40 of the pedals 8 can be covered by a protective covering 56 to prevent injury. Similarly, the back end 42 of the pedals 8 can include a protective covering.

Figure 14:
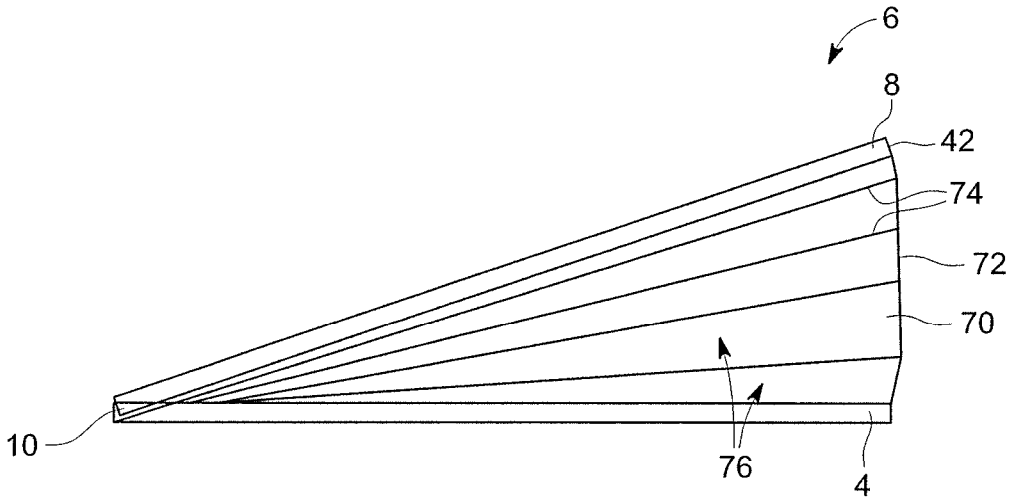
FIG. 14 illustrates one embodiment of a protective bellows coupled to a pedal assembly.
Figure 15:
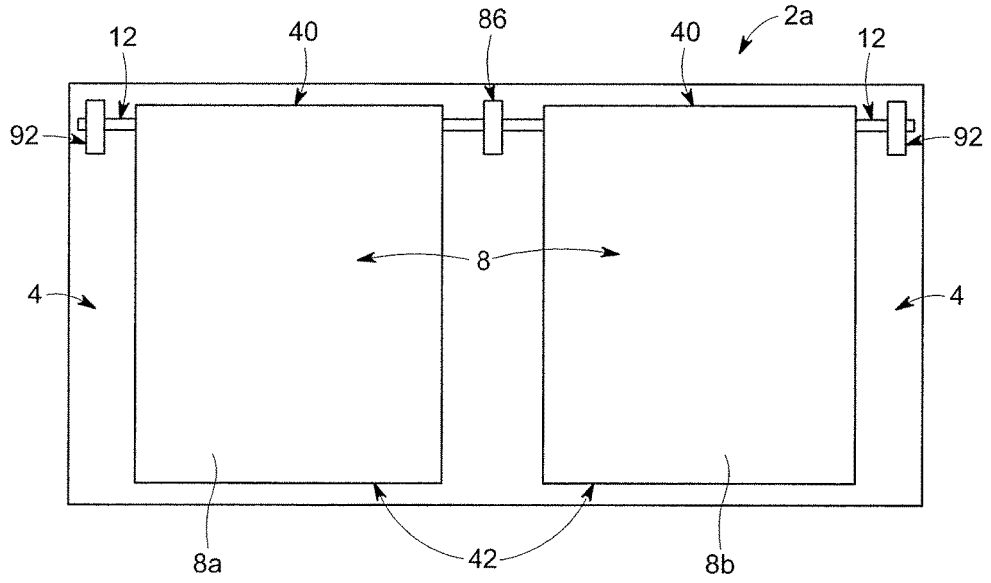
FIG. 15 illustrates a top-down view of one embodiment of a dampening platform.
Figure 16:
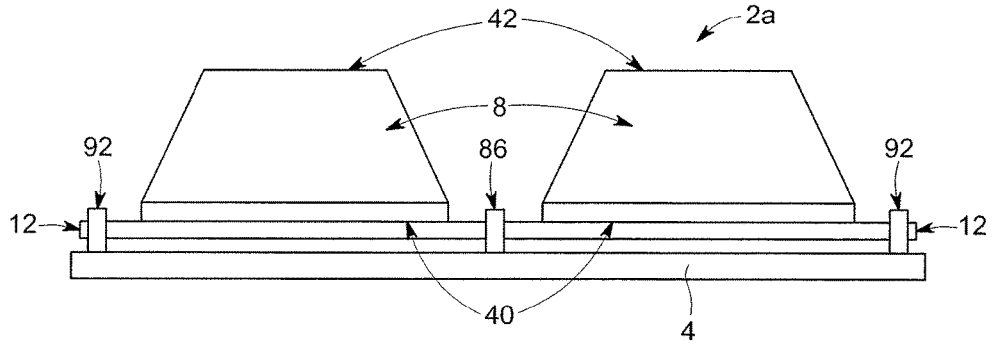
FIG. 16 illustrates a front view of the dampening platform of FIG. 15.
Figure 17:
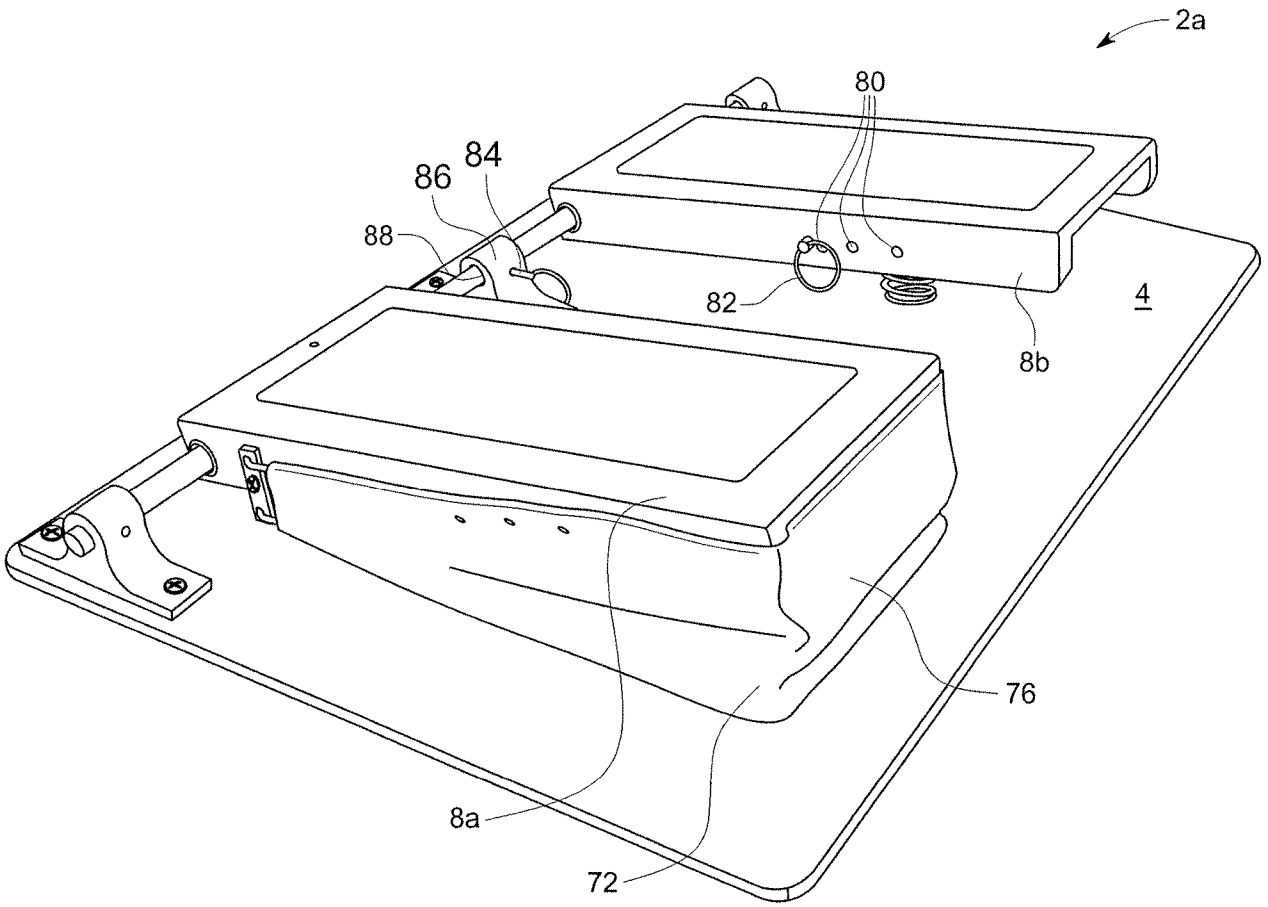
FIG. 17 illustrates a perspective view of the dampening platform of FIG. 15 having a protective bellows coupled to a pedal assembly.
Figure 18:
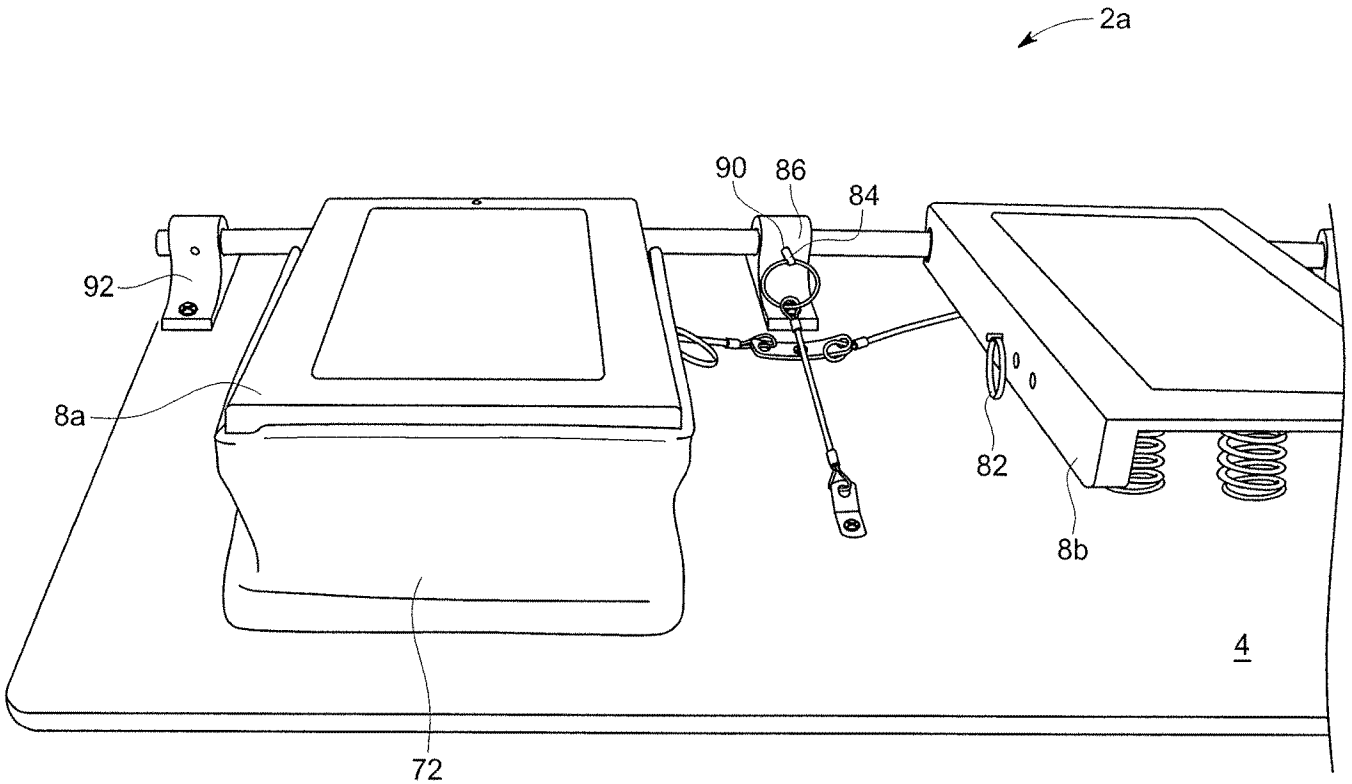
FIG. 18 illustrates a side view of the dampening platform of FIG. 17.
Figure 19:
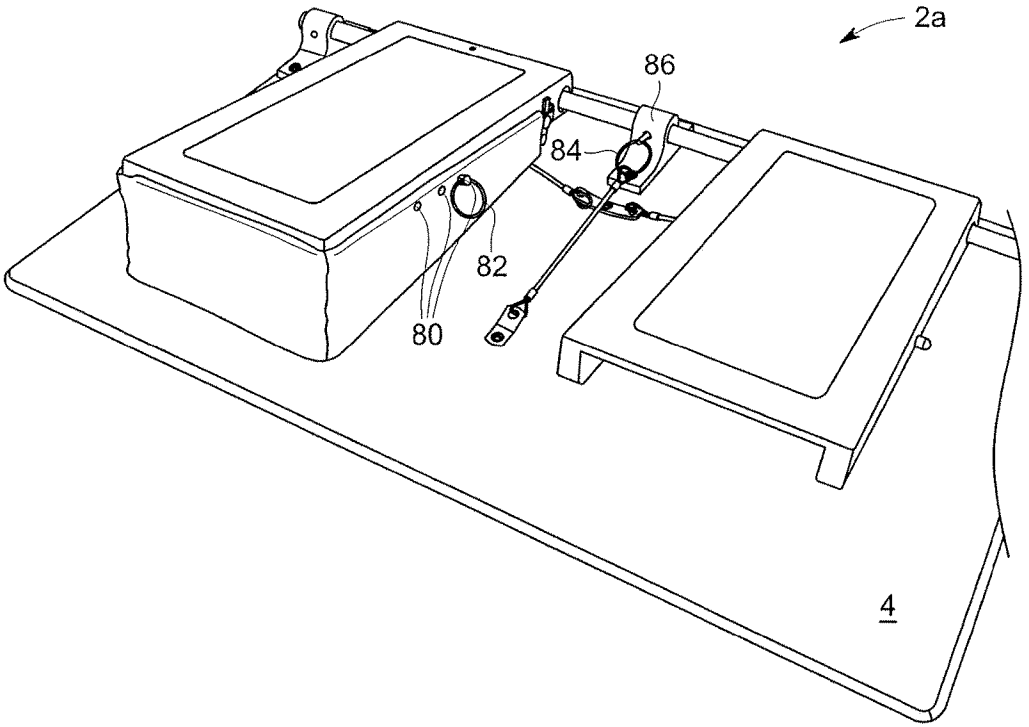
FIG. 19 illustrates a front view of the dampening platform of FIG. 17.

FIG. 14 illustrates one embodiment of a pedal assembly 6 having a protective bellows covering 70 coupled between the pedal 8 and the base 4. In some embodiments, the protective bellows covering 70 can be coupled to the bottom surface of the pedal 8, the perimeter of the pedal 8, or both. In some embodiments, the protective bellows covering 70 includes a protective end cover 72 coupled between the back end 42 of the pedal 8 and the base 4.

As shown in FIG. 14, in some embodiments, a plurality of wire inserts 74 extend between the protective end cover 72 and a front end 40 of the pedal 8. The plurality of wire inserts 74 define a plurality of collapsible baffles 76 that are configured to at least partially collapse when a force is applied to the pedal 8. The protective end cover 72 prevents articles, such as a user's foot or loose equipment on the boat from getting under the pedal 8 and interfering with operation of the pedal assembly 6 or getting caught and injuring the user or breaking an object. In some embodiments, the protective end cover 72 includes a weatherproof, flexible fabric configured to protect the pedal assembly 6 from water or other environmental factors.

Figure 13:
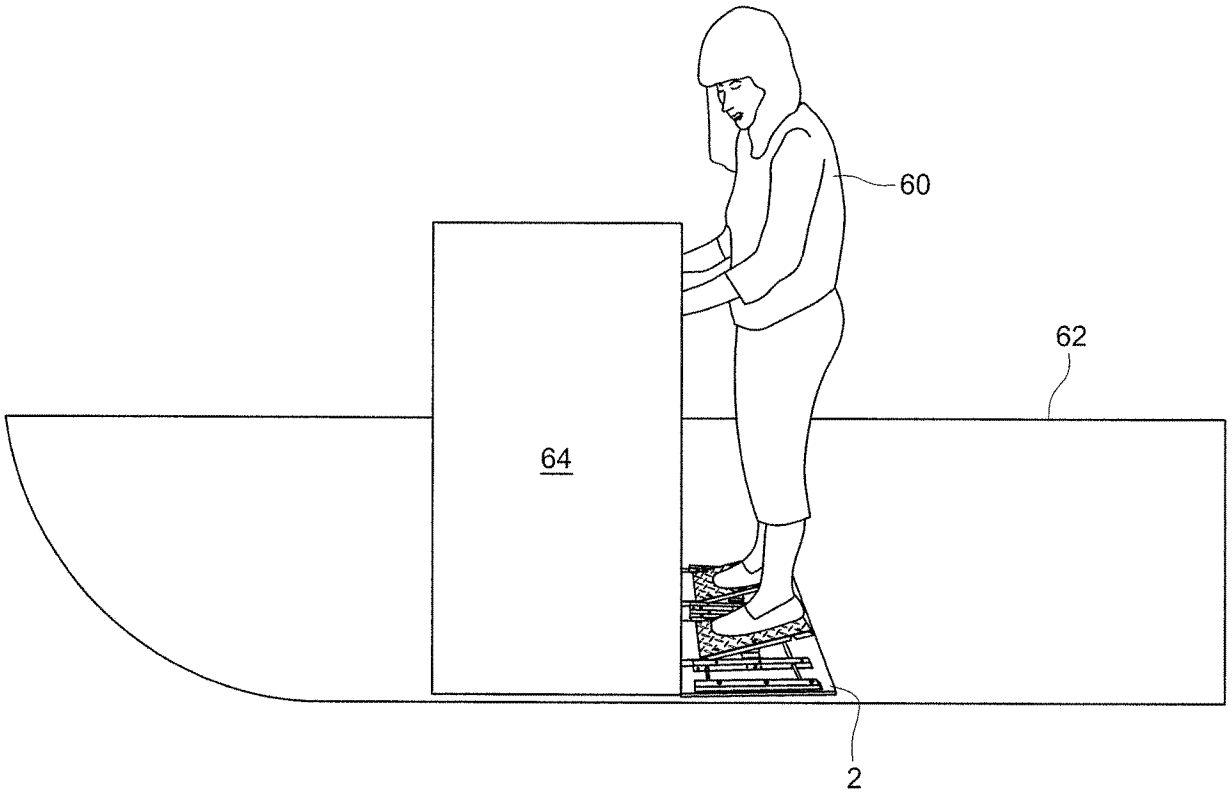
FIG. 13 illustrates a user standing on a dampening platform during operation of a boat.

FIG. 13 illustrates one embodiment of a user 60 interacting with a dampening platform 2 positioned on a boat 62. The dampening platform 2 is positioned adjacent to a control console 64 of the boat 62. The pivot points 10 of the pedals 8 are positioned closest to the control console (e.g., the pivot points 10 are adjacent to, or defined by, the dampening platform 2). A user 60 stands on the pedals 8 during operation of the boat 62. As the boat experiences forces (e.g., encounters waves, wakes, etc.), the dampeners 20 absorb some of the force and transmit less of a jolt to the user's 60 legs and spine. By placing the pivot points 10 at the front of the dampening platform 2, the dampening platform 2 allows a user to maintain a relatively stationary position while reducing the shock (e.g., force) experienced by the user. As shown in FIG. 13, when under load, the dampeners 20 maintain a minimum spacing 16 between the pedals 8 and the base 4 to provide additional absorption, or play, for absorbing additional shock when the boat 62 experiences a wave or wake).

FIGS. 15-19 illustrate one embodiment of a dampening platform 2*a*. The dampening platform 2*a* is similar to the dampening platform 2 described above and similar description is not repeated herein. In contrast to the dampening platform 2 discussed above, the dampening platform 2*a* includes only a front slide bar 12*a* and omits the side supports 14, the middle support 18, and the second slide bar 12*b*. The dampening platform 2*a* provides an unobstructed base 4 for easy pass-through when the dampening platform 2*a* is not in use.

In some embodiments, the dampening platform 2*a* includes a first pedal 8*a* and a second pedal 8*b* having a plurality or holes 80 formed in the side edges of the pedals 8. The plurality of holes 80 correspond to selectable positions of the at least one dampening spring 22. For example, in some embodiments, the dampening support 24 includes at least one hole 80 sized and configured to receive a pin 82 therethrough. The dampening support 24 can be positioned such that the at least one hole on the dampening support 24 aligns with one of the plurality of holes 80. A pin 82 is inserted through the selected one of the plurality of holes 80 and the at least one hole in the dampening support 24 to maintain the dampening support in a fixed position. The pin 82 can be removed and the position of the dampening support 24 can be adjusted to correspond to a second of the plurality of holes 80.

Figure 20:
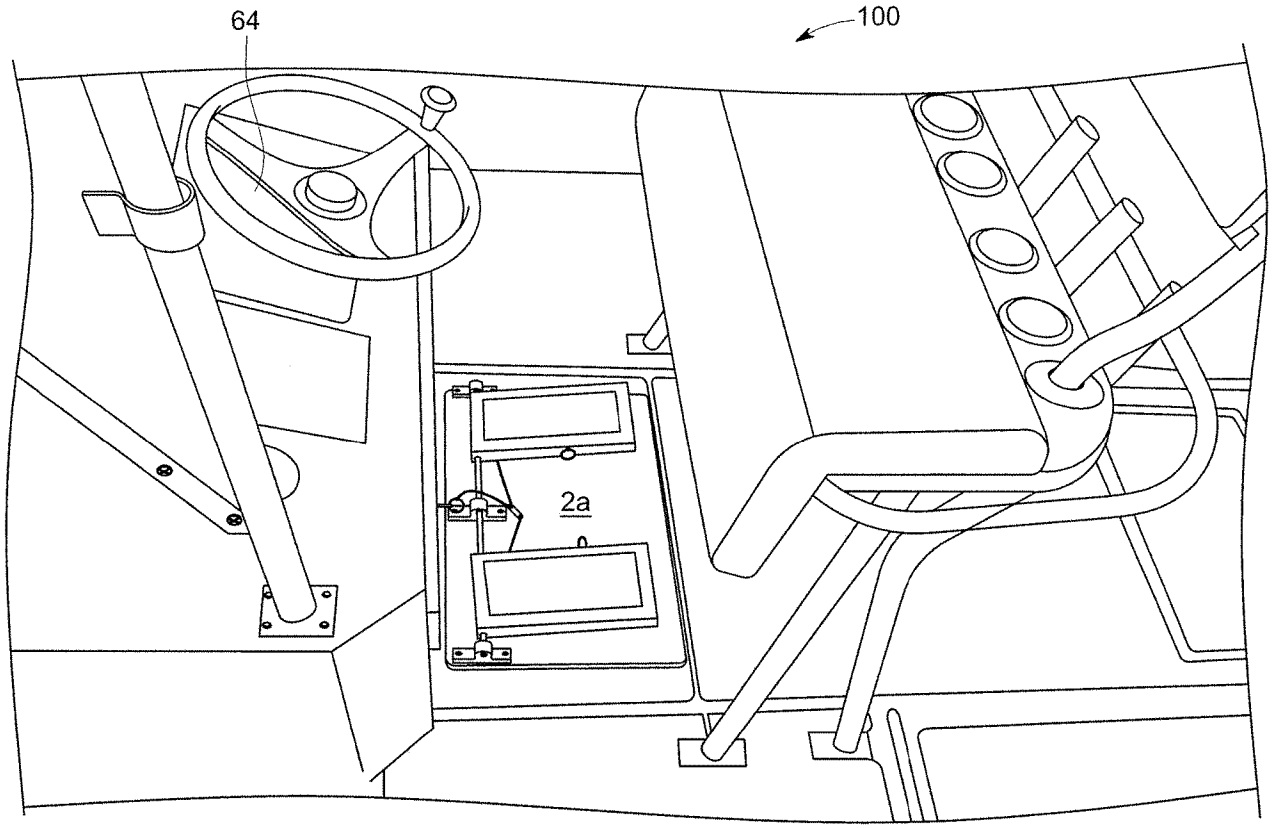
FIG. 20 illustrates a dampening platform operatively positioned on a boat.

In some embodiments, the dampening platform 2*a* includes a protective end cover 72 coupled to at least one of the pedals 8. The protective end cover 72 can be adapted to prevent objects, including body parts, from getting under the pedal 8*a*, 8*b*, which prevents injury and facilitates full motion of the pedal. The protective end cover 72 extends from the base 4 to the first pedal 8*a* and extends about the periphery of the first pedal 8*a*. The second pedal 8*b* would include a similar protective end cover 72. The protective end cover 72 includes a weatherproof, flexible fabric configured to collapse and/or expand in response to movement of the pedal 8*a*. For example, in the illustrated embodiment, the protective end cover 72 includes a plurality of baffles 76 configured to collapse and/or expand in response to movement of the pedal 8*a*. FIG. 20 illustrates one embodiment of the dampening platform 2*a* operatively installed in a boat 100. The dampening platform 2*a* is positioned adjacent to a control console 64 of the boat 100.

Figure 21:
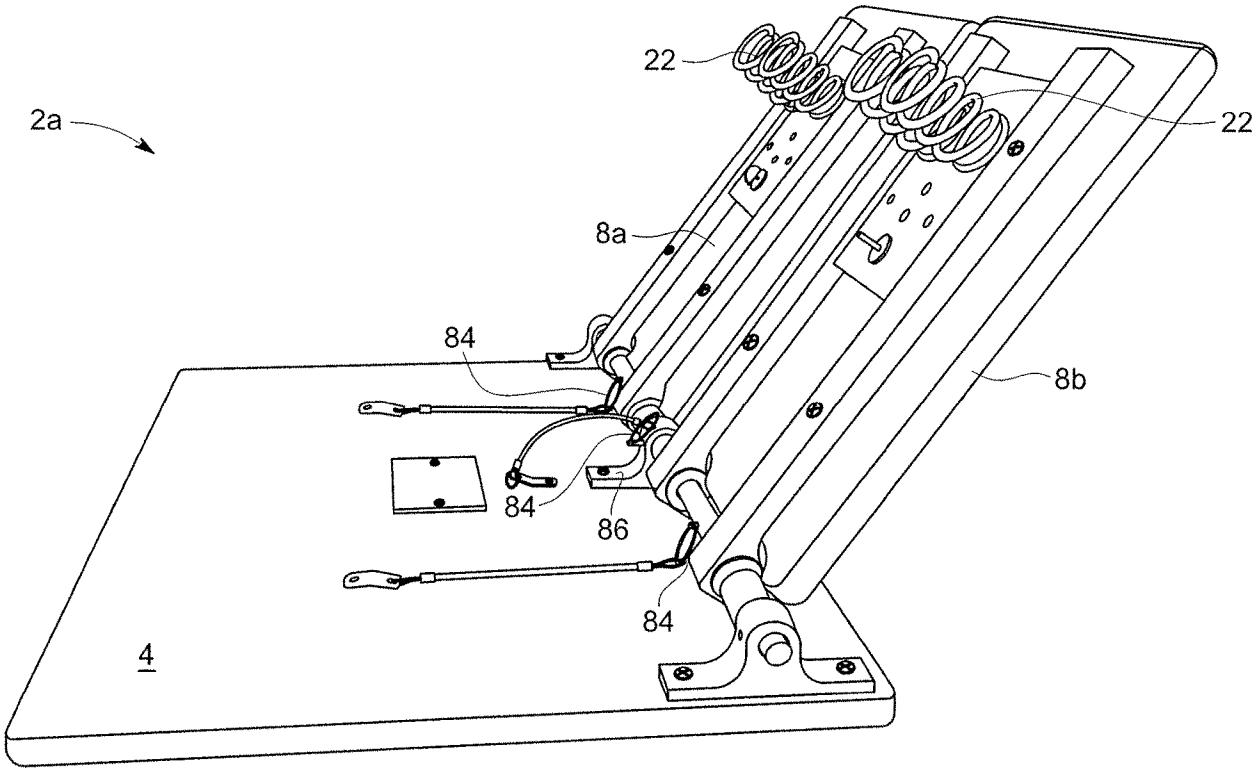
FIG. 21 illustrates a side view of a dampening platform in a storage position with the pedals in a generally vertical orientation.
Figure 22:
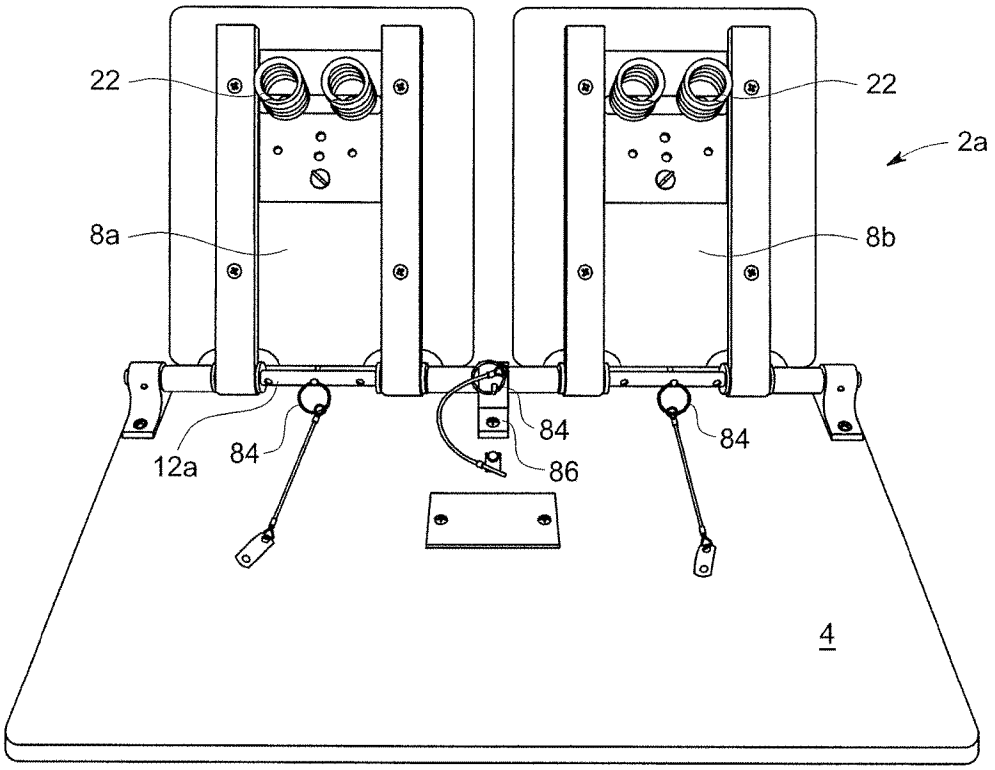
FIG. 22 illustrates a front view of a dampening platform in a storage position with the pedals in a generally vertical orientation.
Figure 23:
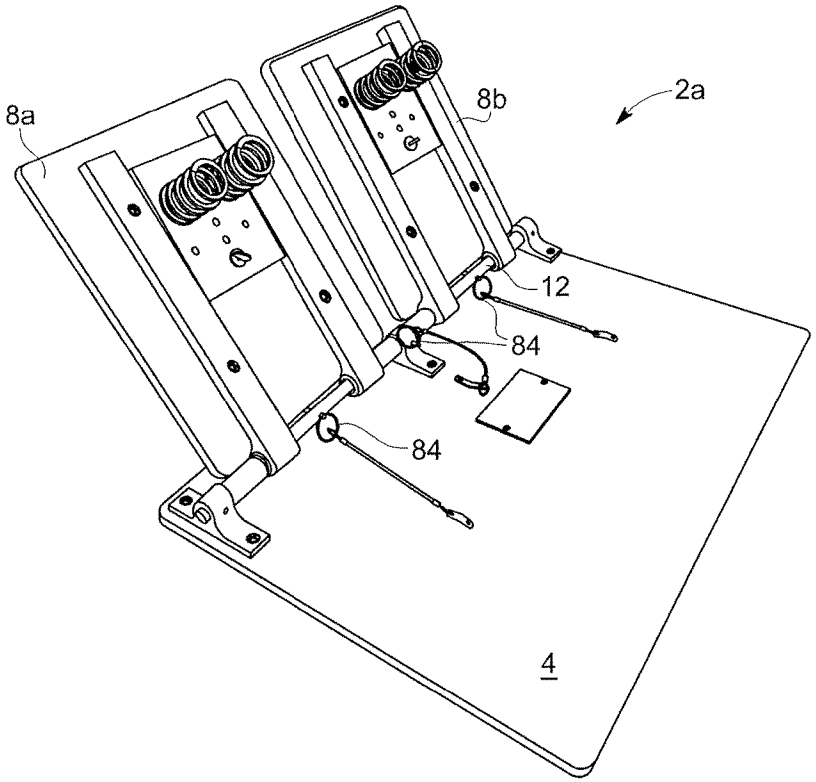
FIG. 23 illustrates a front, perspective view of a dampening platform in a storage position with the pedals in a generally vertical orientation.

In some embodiments, the dampening platform 2*a* includes one or more pins 84 coupled to the front slide bar 12*a*. The pin 84 is configured to maintain the pedals 8 in a fixed position. For example, a horizontal position when the pedals 8 are in use, as shown in FIGS. 15-20, and a vertical position when the pedals are not being used, as shown in FIGS. 21-23. For example, in the illustrated embodiment, the dampening platform 2*a* includes a slide bar support 86 defining a hole 88 therethrough. The first slide bar 12*a* is inserted through the hole 88 and is supported by the slide bar support 86. The slide bar support 84 defines a first pin hole 90 and the first slide bar 12*a* defines a second pin hole (not shown). The pin 84 is inserted through the first pin hole 90 and the second pin hole to maintain the first slide bar 12*a* at a fixed rotation with respect to the slide bar support 84. The slide bar 12 can include one hole to maintain the pedals 8 in a horizontal use position and a second hold to maintain the pedals in a vertical storage position. When the pin 84 is removed, the first slide bar 12*a* is allowed to rotate about a longitudinal axis of the first slide bar 12*a*, allowing use of the dampening platform 2*a*. In some embodiments, side slide bar supports 92 include at least one pin hale 88 configured to receive a pin 84 therein.

Although the subject matter has been described in terms of various embodiments, it is not limited thereto. Rather, the appended claims should be construed broadly, to include other variants and embodiments, which may be made by those skilled in the art.

What is claimed is:

1. A boat shock-dampening platform comprising:
a base configured to be supported on a boat deck; and
a first pedal assembly coupled to a first side of the base, comprising:
a first pedal pivotably rotatable about a first pivot point at a front portion of the first pedal; and
a first dampener operatively coupled to a back portion of the first pedal,
a second pedal assembly coupled to the base, the second pedal assembly comprising:
a second pedal pivotably rotatable about a first pivot point at a front portion of the second pedal; and
a second dampener operatively coupled to a back portion of the second pedal,
wherein the first pedal and the second pedal are each, independently, configured to move between a raised position and a bottomed out position where the first dampener and second dampener, respectively, are completely compressed,
wherein each of the first dampener and the second dampener comprises a coiled spring configured to prevent the first pedal and second pedal, respectively, from bottoming out under a load of 200 lbs.

2. The dampening platform of claim 1, wherein the first pedal assembly is slideably coupled to the base, and wherein a position of the first pedal assembly is laterally adjustable with respect to the base.

3. The dampening platform of claim 2, comprising a slide bar coupled to the base, wherein the first pedal assembly is slideably coupled to the slide bar at the first pivot point.

4. The dampening platform of claim 3, comprising at least one locking element configured to lock the first pedal assembly in a fixed position on the slide bar.

5. The dampening platform of claim 1, wherein the first pedal and the second pedal are independently moveable.

6. The dampening platform of claim 1, wherein the second pedal assembly is slideably coupled to the base, and wherein a position of the second pedal assembly is laterally adjustable with respect to the base.

7. The dampening platform of claim 1, wherein the first pedal includes a non-slip coating.

8. The dampening platform of claim 1, wherein a second side of the base includes a non-slip coating.

9. The dampening platform of claim 1, wherein the base comprises a uniform, rigid, continuous base.

10. The dampening platform of claim 1, wherein each of the first dampener and the second dampener comprise two coiled springs configured to prevent the first pedal and second pedal, respectively, from bottoming out under a load of 400 lbs.

11. The dampening platform of claim 1, wherein each of the first dampener and the second dampener is longitudinally adjustable under the first pedal and the second pedal, respectively.

12. The dampening platform of claim 1, wherein each of the first dampener and the second dampener comprises a coiled spring configured to prevent the first pedal and second pedal, respectively, from bottoming out under a load of 225 lbs.

13. The dampening platform of claim 1, wherein each of the first dampener and the second dampener comprises a coiled spring configured to prevent the first pedal and second pedal, respectively, from bottoming out under a load of 250 lbs.

* * * * *